US005452500A

United States Patent [19]

Revis

[11] Patent Number: 5,452,500

[45] Date of Patent: Sep. 26, 1995

[54] ONE PIECE SPRING CLIP

[76] Inventor: Arthur N. Revis, 1235 D'Amico Dr., Chicago Heights, Ill. 60411

[21] Appl. No.: 299,435

[22] Filed: Sep. 1, 1994

Related U.S. Application Data

[63] Continuation-in-part of Ser. No. 50,899, Apr. 12, 1993, Pat. No. 5,361,463.

[51] Int. Cl.[6] ..... A44B 21/00

[52] U.S. Cl. ..... 24/543; 24/499; 24/557

[58] Field of Search ..... 24/543, 499, 508, 24/557, 545, 562

[56] References Cited

U.S. PATENT DOCUMENTS

| | | | |
|---|---|---|---|
| 3,604,071 | 9/1971 | Reimels | 24/543 |
| 3,629,912 | 12/1971 | Klopp | 24/543 |
| 3,733,656 | 5/1973 | Stalder | 24/557 |
| 4,395,799 | 8/1983 | Batts | 24/557 |
| 4,762,296 | 8/1988 | Kraus et al. | 24/543 |
| 4,763,390 | 8/1988 | Rooz | 24/557 |
| 4,839,947 | 6/1989 | Cohen et al. | 24/499 |
| 4,840,341 | 6/1989 | Hasegawa . | |
| 5,199,140 | 4/1993 | Valiulis et al. | 24/562 |

FOREIGN PATENT DOCUMENTS

| | | | |
|---|---|---|---|
| 2278006 | 2/1976 | France | 24/557 |
| 2360706 | 3/1978 | France | 24/499 |
| 1225812 | 3/1971 | United Kingdom | 24/557 |

*Primary Examiner*—Victor N. Sakran
*Attorney, Agent, or Firm*—Milton S. Gerstein

[57] ABSTRACT

The basic clip enclosed is a one-piece plastic clip formed by an upper and lower jaw element having gripping jaws. The jaw elements are pivoted together by a pedestal-type mount, that interconnects the upper and lower jaw elements together. The pedestal mount has a locking tip which fits into a receptacle formed in the upper jaw element. A U-shaped biasing member biases the jaw elements into their closed, clamping position, which biasing member has a base lying in close proximity to the pedestal mount. A camming finger causes the pedestal mount to bend every time that the rear sections of the jaw elements are squeezed to open the clamping jaws, which bending increases the clamping force of the clip.

13 Claims, 4 Drawing Sheets

FIG. 2
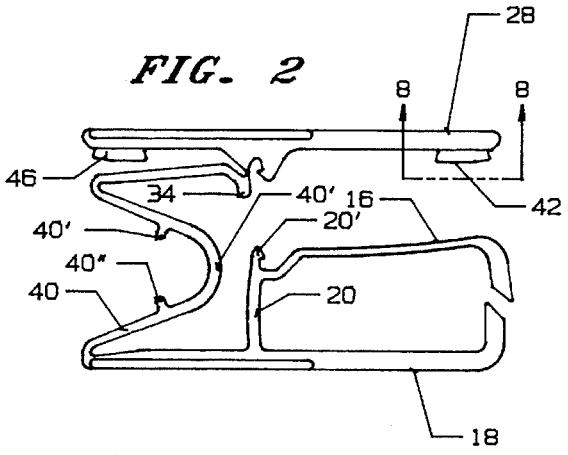
FIG. 1
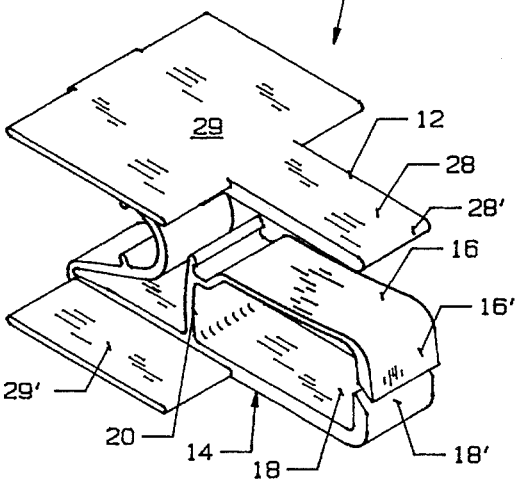
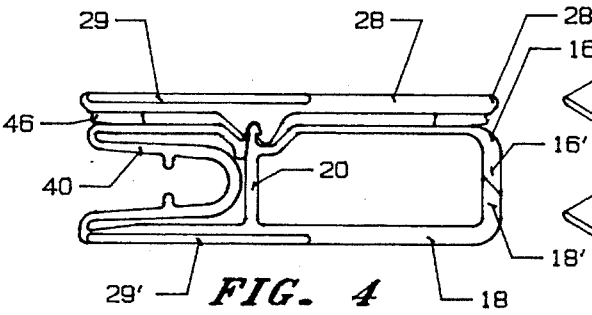
FIG. 4
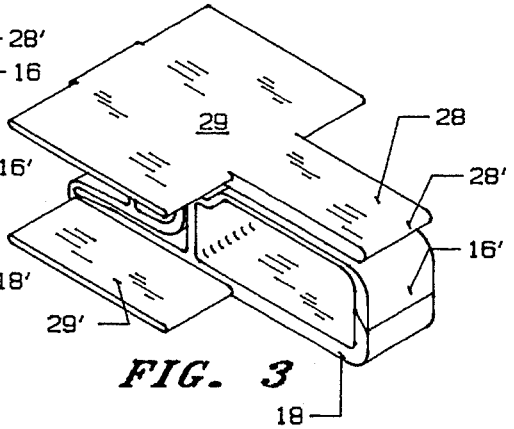
FIG. 3
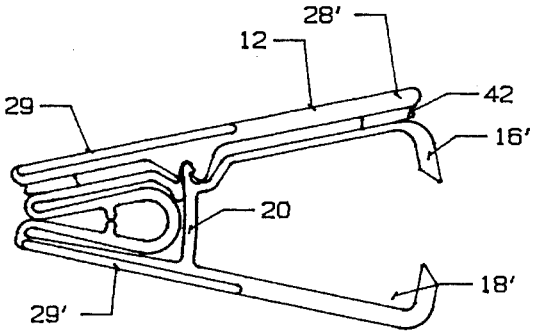
FIG. 6
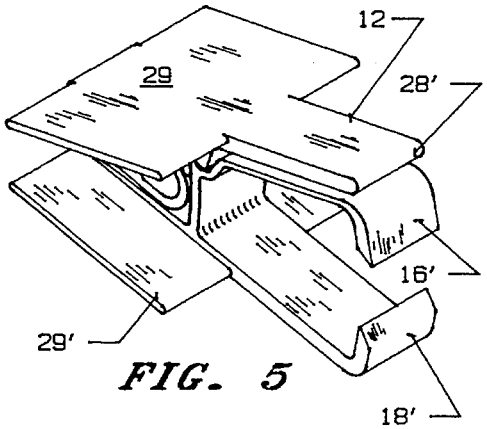
FIG. 5

FIG. 7
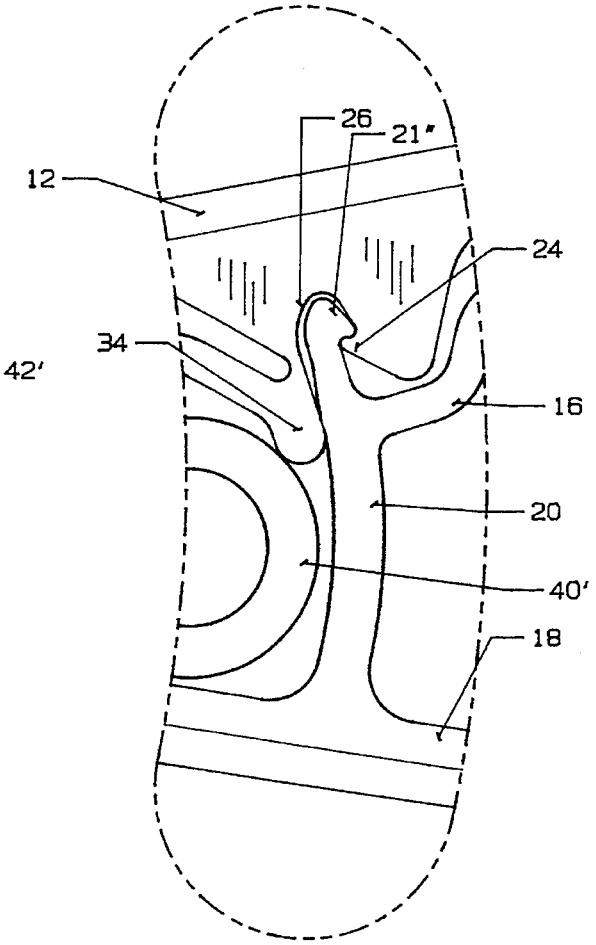
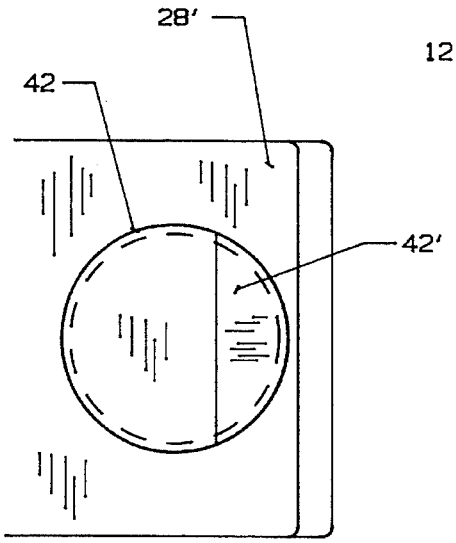
FIG. 8
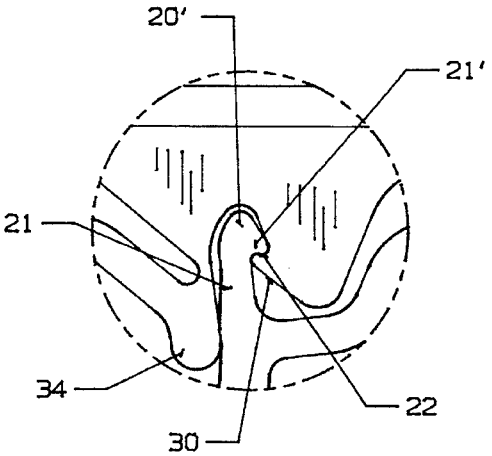
FIG. 10
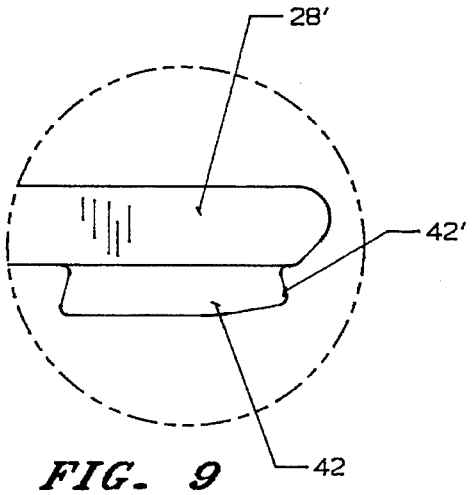
FIG. 9

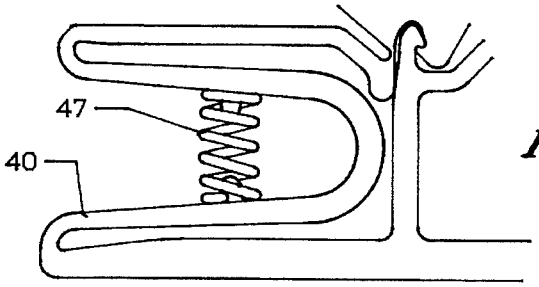
FIG. 11
FIG. 12
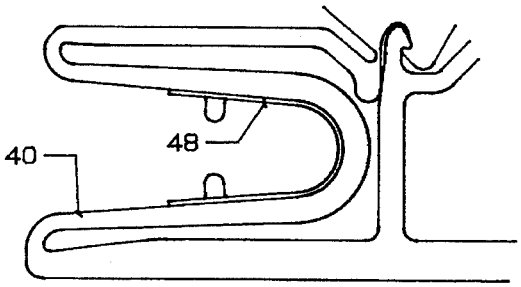
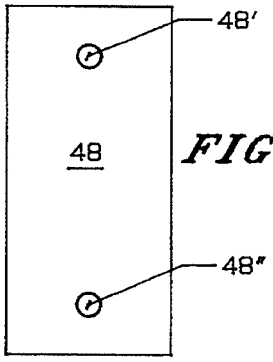
FIG. 13
FIG. 14
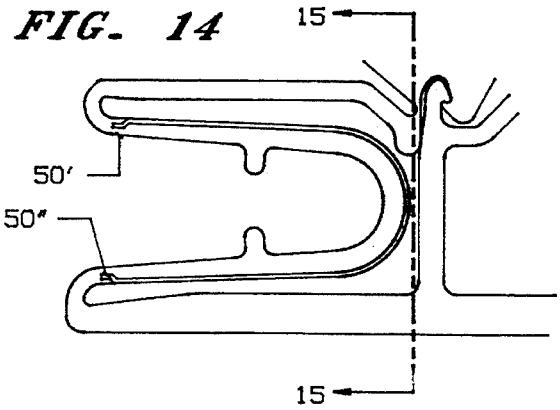
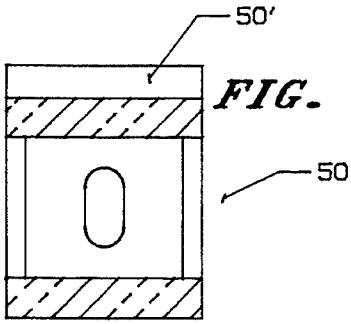
FIG. 15
FIG. 16
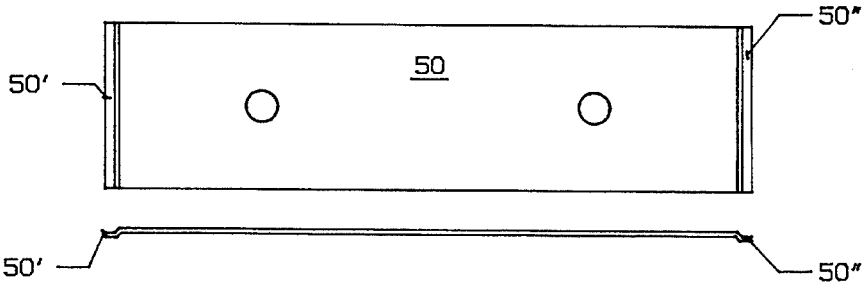
FIG. 17

ONE PIECE SPRING CLIP

CROSS REFERENCE TO RELATED APPLICATION

The present application is a continuation-in-part of application Ser. No. 08/050,899, filed on Apr. 12, 1993, now U.S. Pat. No. 5,361,463, which is incorporated by reference herein.

BACKGROUND OF THE INVENTION

1. Field of the Invention

This invention relates generally to spring clips for holding items, and more particularly, to a new and improved single piece plastic clip having an integrated latching feature.

2. Description of the Prior Art

Spring clips are well known in the art. Such clips are used for holding badges, memos, documents, clothing, and anything else that will fit between the jaws of the clip.

Variations of the spring clip include materials of construction, jaw size, methods of attaching the clip to fixtures, and various methods to accomplish the biasing of the jaws in a closed position. For instance, a typical clip found in any home is constructed of plastic, sized to hold multiple sheets of paper, incorporates a magnet for attachment to a refrigerator door, and utilizes a metal pintle-type spring for biasing the jaws of the clip in a closed position. Most office clips have multiple parts involving wire axis and coil springs that must be compressed manually during assembly operation. Incorporating the biasing mechanism into the body of the clip, as in a flexible metal closure, is also used to permanently bias the jaws in a closed position.

Such clips, and the numerous variations thereto, all require multiple parts making assembly time consuming especially if the variation requires the bending of parts for assembly. Prior art clips made exclusively of plastic, wherein the biasing means is a molded plastic internal clip whose resiliency permits replacement of the conventional spring, is made of plastic whose resiliency is separate than the clip itself. Further, since the biasing means is made separate from the clip, the cost of clip manufacture is increased.

SUMMARY OF THE INVENTION

The present invention is a single piece plastic clip having a resilient biasing member formed between the base members of axial spaced apart jaws.

The clip is constructed of a single piece of molded plastic having two axially spaced jaw members that can be manually separated by squeezing an outer portion of the clip. Opening of the jaws requires pressing a compression section of the clip.

Thus, a primary objective of the instant invention is to provide a complete clip from a single step of manufacturing including the biasing mechanism, jaws, leverage handles, and a locking mechanism from a single piece of material thereby eliminating additional assembly.

Yet another object of the instant invention is to provide various traverse support member designs all of which are capable of eliminating separate spring biasing components and retain shafting without the need for a conventional clip-jaw.

Another object of the instant invention is to place the center of gravity at the rear of the clip allowing the weight of the clip to orient its primary jaws downward for ease of attachment to a garment when assembled around a clothes-hanger cross-bar. This orientation allows the clip to remain in a stationary position for optimum indicia display.

Yet still another object of the instant invention is to provide all clip faces in a parallel position to one another for optimum indicia display and/or for attachment of adhesive or magnetic materials. Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

FIG. 1 is a perspective view of the clip of the invention, shown for use for holding an identifying card, and the like, before final assembly;

FIG. 2 is a side view thereof showing the clip before final assembly;

FIG. 3 is a perspective view of the clip of the invention, shown for use for holding an identifying card, and the like, after final assembly;

FIG. 4 is a side view thereof showing the clip after final assembly;

FIG. 5 is a perspective view of the clip of FIG. 1, the clip in its open position;

FIG. 6 is a side view thereof showing the clip in its open position;

FIG. 7 is an enlarged detail view of the central, integral, flexible fulcrum bar of the clip of FIG. 1;

FIG. 8 is a bottom view of the upper, auxiliary jaw element, taken along line 8—8 of FIG. 2;

FIG. 9 is an enlarged detail side view of the downwardly projecting retaining bead in the upper auxiliary jaw element;

FIG. 10 is an enlarged detail view of the mating engagement between the upper camming member of the fulcrum with a cooperating opening formed in the upper auxiliary jaw element;

FIG. 11 is side view of a modified form of the clip utilizing a metal coil spring for additional biasing;

FIG. 12 is a side view of a modified form of the clip utilizing a metal leaf spring for additional biasing;

FIG. 13 is a front elevational view of the metal leaf spring shown in FIG. 12;

FIG. 14 is a side view of a modified, molded-metal leaf spring of the clip of FIG. 12;

FIG. 15 is a cross-sectional view taken along line 15—15 of FIG. 14;

FIG. 16 is a front elevational view of the metal leaf spring shown in FIG. 14;

FIG. 17 is a side view of the metal leaf spring shown in FIG. 16;

DETAILED DESCRIPTION OF THE INVENTION

Figure 18:
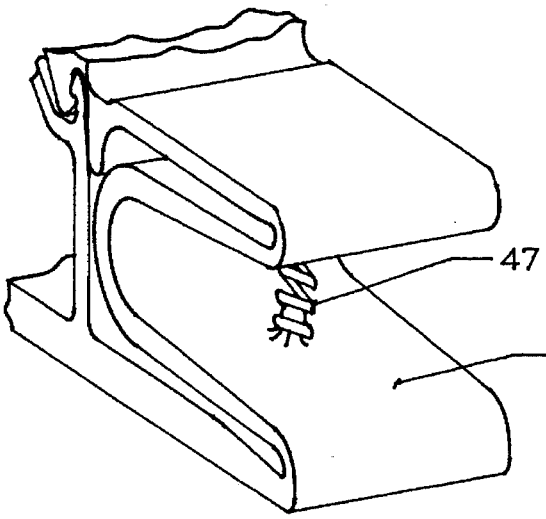
FIG. 18 is a perspective view of the clip of the invention shown in FIG. 11.

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Now referring to the drawings beginning with FIGS. 1 through 10, reference numeral 10 indicates a one piece clip formed from a single piece of plastic. The clip 10, after having come out of a mold, requires the one additional step of assembly of clamping the upper portion of the clamp with its lower portion, as seen in FIGS. 1 and 2, and as described in copending application Ser. No. 08/050,899. Final assembly of the clip or clamp 10 is achieved by forcing the upper section downwardly against the lower section. The clamp or clip 10 has an upper section 12 and a lower section 14. The lower section 14 is provided with two, primary, clamping jaw elements 16, 18, that define exterior gripping jaws 16' 18'. The two jaw elements 16, 18 are connected at their interior ends by an upstanding, fulcrum member 20. The interior end of the jaw clement 16 is connected near the upper end of the fulcrum member 20, while the interior end of the jaw element 18 is connected near the bottom end of the fulcrum member 20. The interior end of the jaw element 16 is slightly skewed so that the end-most portion thereof lies in a plane offset from the remainder. This skewing allows for greater flexibility of the jaw element 16 and also allows accommodation of a protruding portion of an upper, auxiliary jaw element, described hereinafter. The fulcrum member 20 is made as one piece with the rest of the clip during the manufacturing process, such as injection molding, and has an upper thinner section 20' that terminates in an upper, prong-like tip, best seen in FIGS. 7 and 10. This thinner section 20' has a smaller thickness as compared with the rest of the fulcrum member 20, and has a tapering section 21 that terminates in a larger beaded tip or end. The tip has a retaining undersurface 22 that latches against a cooperating latching surface 24' of latching projection 24 formed in an opening 26 of upper auxiliary jaw element 28. The tip also has a canted surface 21", which is used for temporary contact against canted surface 30 of the downwardly-projecting latching projection 24 during the insertion of the tip into the opening 26 during final assembly of the clip. The canted, cooperating surface 30 forces the surface 21 outwardly during insertion, in order to allow for entry of the tip into the opening and for the engagement of the latching surfaces 22 and 30 against each other for final assembly. The tapering section 21 allows for the clearance past the downwardly-extending pressure or bending member 34, described hereinbelow. This clearance obviates the need for causing the downwardly-extending pressure member 34 from having to be pushed aside during entry of the tip 31 of final assembly, since the narrower tapering section 21 is thin enough so as to be juxtapositioned against the downwardly-extending pressure member 34 during insertion of tip, until the tip has completely entered into the opening 26 and has been latched therein. Thus, the narrower section ends just at the point of contact of the fulcrum member against a portion of the downwardly-extending pressure member 34, as best seen in FIG. 10. The thickness of the tip is still less than the thickness of the main body of the fulcrum member 20, so that the downwardly-extending pressure member 34 is never pushed aside during final assembly, which allows for a much easier final assembly; however, the thickness of the tip is great enough so as to provide a proper latching fit in the opening 26 between cooperating latching surfaces 22 and 24.

As stated above, the clip 10 has a third, upper auxiliary jaw element 28. It is noted, however, that if a clip with just two jaws were desired, and no auxiliary jaw element, such as shown and described in Applicant's copending application Ser. No. 08/050,899, then the upper primary jaw element 16 may be eliminated, whereby the jaw element 28 becomes the upper, primary jaw element. Otherwise, the structure of the two-jaw clip would be identical to that shown in FIGS. 1–10. Examples of two-jaw element clips are shown and described in Applicant's copending application Ser. No. 08/050,899, and are incorporated herein. The upper auxiliary jaw element 28, and the lower, primary jaw element 18 may have enlarged interior ends 29, 29' in order to allow for imprintation and for the easier squeezing together thereof when opening the jaw elements for insertion of an item to be clipped or clamped. The upper, auxiliary jaw element 28, as described above, has a downwardly-extending pressure member 34, which is used for causing the fulcrum member to be arched during the opening of the jaw elements when the enlarged ends 29, 29' are squeezed toward each other, in the manner shown in FIG. 7. This arching or bending of the fulcrum not only provides additional biasing forces for clamping the jaw elements closed, since the bending of the fulcrum member creates restoring forces in the naturally flexible and resilient material from which the fulcrum member is made, such material being, for example, polyacetal, but also causes the two primary clamping jaws to separate from each other during opening to a greater distance than would otherwise be the case if no pressure member or bending member were provided. As stated above, the length of the downwardly-extending pressure or bending member is such as to contact against the interior face of the fulcrum member at the location thereof just before the start of the tapered section 21, so that the flexing of the fulcrum member 20 is made easier, owing to the narrower section joined thereat, which allows for greater ease of flexing by means of the juncture of the end of the tapering section 21 with the remainder of the main body of the fulcrum member which is of greater thickness. The pressure member 34 may, alternatively, extend upwardly from the lower jaw element, as long as it causes the fulcrum member 20 to bend when the jaw elements are opened. When the two rear portions of the jaw 29, 29' are squeezed together, the initial squeezing will open, or separate, the two, primary clamping jaws 16', 18' by means of the pressure member 34. Continued squeezing of the rear portions 29, 29' will then also cause the upper, auxiliary clamping jaw 28' to open, or separate, from its contact with the upper, primary clamping jaw 16'. The opening, or separation, of the upper, auxiliary clamping jaw 28' is slight as compared to the opening of the primary clamping jaws 16', 18'.

The primary biassing force for the clip 10 emanates from a U-shaped biassing member 40, as described in Applicant's copending application Ser. No. 08/050,899. This U-shaped biasing member 40 defines a base 40' that ideally lies as close as possible to the fulcrum member 20 as possible, which allows the prongs in the U-shaped spring to contain a shaft of a hanger, or the like, and still be able to be fully squeezed in order to open the jaws to the maximum. The U-shaped spring may be, for example, spaced from the fulcrum member a distance of less than 0.10 inch, or may even touch the fulcrum member. Since the U-shaped spring 40 and the fulcrum member 40 are in such close juxtaposition, they both act as a fulcrum, while the U-shaped biassing member creates a greater biasing action thereby.

The upper, auxiliary jaw element 28 may be provided with a downwardly-projecting, retaining bead 42, best seen in FIGS. 2, 8 and 9. The bead 42 may be received in a cutout or hole formed in an identification card that is to be held or clamped between the jaw elements 28 and 16. The bead 42 has a forwardly facing upwardly-canted surface 42'. The canted surface 42' allows for the forward edge of an identification card to be inserted without having to squeeze together the ends 29, 29'. By inserting the edge of the card and forcing it against the canted surface 42', continued forced insertion causes the bead 42 to be lifted away from its contact against the upper surface of the jaw element 16, so that the card may be slid in. The card is slid in until the hole or opening for the circular bead 42 is reached whereupon the bead enters into the hole, for contact again against the upper surface of the jaw element 16, whereby the card is retained in place and the jaw elements biased closed by means of the U-shaped biasing member 40 and by the contact of the downwardly-extending pressure member 34 against the fulcrum member 20. The inward taper on the sides of the bead 42 help to retain the punched identification card onto the bead, thereby resisting an inadvertant pull out of the card during use.

The clip or clamp 10 may also be provided with other, additional clamping jaw elements, like rear, upper jaw element 44, as discussed in Applicant's copending application Ser. No. 08/050,899. The jaw element 44 may also be provided with a circular bead 46 like the bead 42 of the jaw element 28. It is, of course, to be understood that the clip 10 may contain just two jaw elements: The upper one 28 and the lower one 18, without an intermediate one 16. In the case of just a two-jaw element clip, the upper jaw would contain a downwardly-projecting bead, as on jaw element 16, and would contact directly against the upper surface of the gripping jaw 18.

FIGS. 11–20 show alternative designs for the U-shaped biasing member. FIGS. 11 and 18 show the U-shaped biasing member 40 of FIG. 1 strengthened by means of a metal coil spring 47 which reduces plastic stress and provides additional biasing force for the closure of the jaw elements. Mounting of the spring is accomplished by inserting the enlarged tips 40', 40" into the open top and bottom ends, respectively, of the metal spring.

Figure 19:
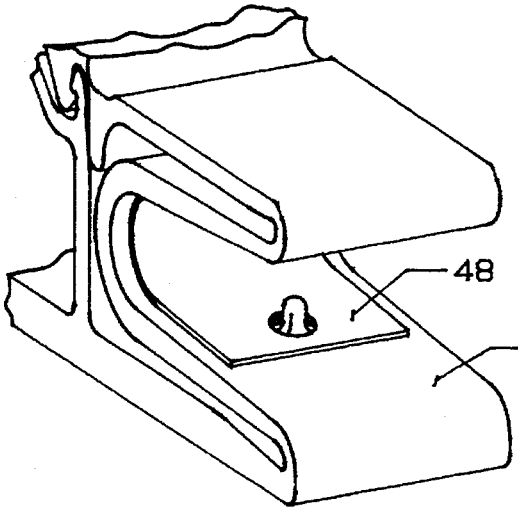
FIG. 19 is a perspective view of the clip of the invention shown in FIG. 12.
Figure 20:
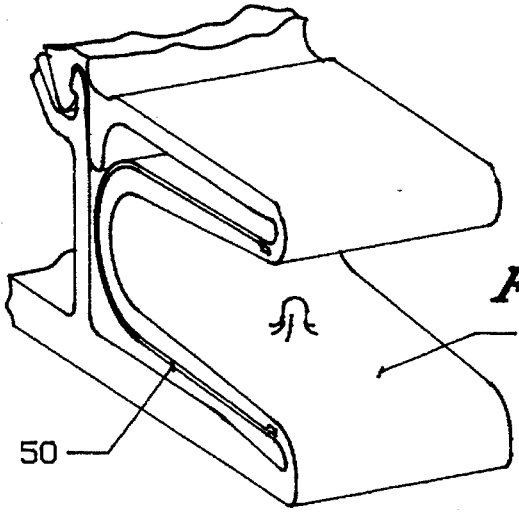
FIG. 20 is a perspective view of the clip of the invention shown in FIG. 14.

FIGS. 12, 13 and 19 show a modification where the U-shaped biasing member 40 is reinforced with a flat, steel leaf spring 48 that is permanently affixed to the interior of the U-shaped member 40. The leaf spring is affixed by snapping the two enlarged projections 40', 40" of the U-shaped member 40 through holes 48', 48" of the leaf spring.

FIGS. 14–17 and 20 show a modification where the U-shaped biasing member 40 is reinforced with a flat, steel leaf spring 50 that is permanently affixed to the exterior of the U-shaped member 40, by means of angled catches or ends 50', 50" formed in the ends of the leaf spring. The U-shaped biasing member 40 is provided with slots or openings for receiving these angled catches or ends 50', 50", or part 50 may be inserted in the mold prior to plastic injection.

While a specific embodiment of the invention has been shown and described, it is to be understood that numerous changes and modifications may be made therein without departing from the scope, spirit and intent of the invention as set forth in the appended claims.

What I claim is:

1. A one-piece clip comprising:

a lower jaw element having a first, front end-portion having a clamping portion thereat, and a second, rear end-portion;

an upper jaw element having a third, front end-portion having a clamping portion thereat, and a fourth rear end-portion;

said fourth, rear end-portion of said upper jaw element having a receptacle-opening formed therein that faces toward said lower jaw element;

fulcrum-mounting means for mounting said second and fourth rear end-portions for pivotal movement toward and away from each other in order to pivot open and pivot close said front end-portions, said fulcrum-mounting means comprising a main body portion having an upper end-section, a lower end-section connected to said second, rear end-portion of said lower jaw element, and an enlarged-head, retaining head-section connected to said upper end-section for forced insertion into said receptacle-opening of said upper jaw element; said enlarged-head retaining head-section and said upper jaw element comprising cooperating latching surfaces for latching said enlarged head retaining head-section in said receptacle-opening;

means for bending said fulcrum-mounting means when said jaw elements are moved toward their open position; and said means for bending said fulcrum-mounting means when said jaw elements are moved into their open position comprising a member having a first section connected to one of said second and fourth rear end-portions, and a second, main section projecting along said fulcrum-mounting means for at least partial contact with said fulcrum-mounting means, whereby said means for bending causes said fulcrum-mounting means to have a biasing force tending to force said first and third clamping portions against each other.

2. The one-piece clip according to claim 1, wherein said upper end-section comprises at least a portion thereof having a thickness less than the thickness of the remainder of said main body portion, whereby insertion of said enlarged-head retaining head-section into said receptacle-opening is facilitated.

3. The one-piece clip according to claim 1, wherein said upper end-section has a thickness at at least a portion thereof that is less than the remainder of said main body portion; said second, main section of said means for bending projecting along said upper end-section of said fulcrum-mounting means for contact thereagainst at said main body portion thereof at a location adjacent to said upper end-section.

4. The one-piece clip according to claim 3, wherein said upper end-section comprises an inwardly tapering upper section connected to said enlarged-head, retaining head-section; said second, main section of said means for bending projecting along said upper portion of said fulcrum-mounting means and contacting against said fulcrum mounting means approximately adjacent to the juncture of said tapering section with the rest of said main body portion.

5. The one-piece clip according to claim 1, wherein said upper end-section of said fulcrum-mounting means comprises at least a portion thereof having a thickness less than the thickness of the remainder of said main body portion, whereby insertion of said enlarged-head retaining head-section into said receptacle-opening is facilitated by allowing said upper end-section to clear said second, main section of said means for bending that projects along said fulcrum-mounting means.

6. A clip comprising:

a lower jaw element having a front end-portion having a clamping portion thereat;

an upper jaw element having an end-portion having a clamping portion thereat;

a pedestal mounting means for mounting said lower and upper jaw elements together so that said clamping portions are pivotal toward and away from each other in order to pivot open and pivot close said clamping portions, said pedestal mounting means comprising a main body portion having a first section operatively connected to said upper jaw element, a second section operatively connected to said lower jaw element; and means for bending said pedestal mounting means when said jaw elements are moved into their open position;

said means for bending said pedestal mounting means when said jaw elements are moved into their open position comprising a bending member having a first section connected to said upper jaw element, and a second, main section projecting along the upper portion of said pedestal mounting means for at least partial contact with said upper portion of said pedestal mounting means.

7. A clip comprising:

a lower jaw element having a front end-portion having a clamping portion thereat;

an upper jaw element having an end-portion having a clamping portion thereat;

a pedestal mounting means for mounting said lower and upper jaw elements together so that said clamping portions are pivotal toward and away from each other in order to pivot open and pivot close said clamping portions, said pedestal mounting means comprising a main body portion having a first section operatively connected to said upper jaw element, a second section operatively connected to said lower jaw element;

biasing means for biasing said upper and lower jaw elements into their closed position; and means for bending said pedestal mounting means when said jaw elements are moved into their open position;

said means for bending said pedestal mounting means when said jaw elements are moved into their open position comprises a camming member having an end connected to one of said jaw elements, and a main section projecting adjacent to a portion of said pedestal mounting means for at least partial contact therewith, whereby when said jaw elements are opened, said main section is forced against said pedestal mounting means to bend it.

8. The one-piece clip according to claim 21, further comprising biasing means for biasing said upper and lower jaw elements into their closed position, said biasing means comprising an approximately U-shaped member having a first, lower end connected to a portion of said second, rear end-portion of said lower jaw element, and a second, upper end connected to a portion of said fourth, rear end-portion of said upper jaw element; said means for bending being connected to, and projecting from, said second, upper end of said biasing means.

9. The one-piece clip according to claim 7, further comprising an intermediate jaw element between said upper and lower jaw elements; said intermediate jaw element having a rear end connected to a portion of said fulcrum mounting means at a location below said enlarged-head, retaining head-section.

10. The one-piece clip according to claim 11, wherein said intermediate jaw element has an upper surface against which said clamping portion of said upper jaw element is forced by said biasing means when said jaw elements are in their closed position.

11. The one-piece clip according to claim 10, wherein said clamping surface of said upper jaw element comprises a downwardly-projecting bead for contact against said upper surface of said intermediate jaw element, said bead being received through a hole of a card inserted between said upper and said intermediate jaw elements, for retaining the card in place.

12. The one-piece clip according to claim 11, wherein said bead comprises a forwardly-facing, canted camming surface against which an edge of a card may be forced for forcing said upper and said intermediate jaw elements apart against the force of said biassing means until the hole in the card receives therethrough said bead of said upper jaw element.

13. The one-piece clip according to claim 12, in combination with a card for insertion between said upper and intermediate jaw elements; said card having a hole for receiving said bead therein when the edge of the card is forced against said forwardly-facing, canted camming surface.

* * * * *